US006695177B2

(12) United States Patent
Blicher

(10) Patent No.: US 6,695,177 B2
(45) Date of Patent: Feb. 24, 2004

(54) APPARATUS FOR DISPENSING A BEVERAGE

(76) Inventor: Anders Blicher, Egebjergvej 4, Nykøbing Sjælland (DK), 4500

( * ) Notice: Subject to any disclaimer, the term of this patent is extended or adjusted under 35 U.S.C. 154(b) by 10 days.

(21) Appl. No.: 10/139,190

(22) Filed: May 2, 2002

(65) Prior Publication Data

US 2003/0205586 A1 Nov. 6, 2003

Related U.S. Application Data

(63) Continuation of application No. PCT/DK00/00604, filed on Nov. 1, 2000.

(30) Foreign Application Priority Data

Nov. 3, 1999 (DK) ..... 1999 01583

(51) Int. Cl.[7] ..... B65D 83/00
(52) U.S. Cl. ..... 222/396; 222/399
(58) Field of Search ..... 222/386.5, 394, 222/396, 399

(56) References Cited

U.S. PATENT DOCUMENTS

| | | | | |
|---|---|---|---|---|
| 2,162,842 A | | 6/1939 | Dolison et al. | 225/1 |
| 2,230,905 A | | 2/1941 | Popky | 62/141 |
| 2,325,228 A | | 7/1943 | Cornelius | 62/141 |
| 2,446,895 A | | 8/1948 | Weiss | 62/141 |
| 2,638,758 A | | 5/1953 | Daun | 62/141 |
| 2,749,930 A | | 12/1956 | Whitnall | 137/212 |
| 2,792,692 A | | 5/1957 | Bryan | 62/144 |
| 2,805,846 A | | 9/1957 | Dewan | 261/121 |
| 3,195,788 A | | 7/1965 | Wilson | 222/399 |
| 3,243,085 A | | 3/1966 | Wilson | 222/396 |
| 4,120,425 A | | 10/1978 | Bethurum | 222/146 |
| 4,222,972 A | | 9/1980 | Caldwell | 261/121 |
| 4,269,333 A | | 5/1981 | Nakai et al. | 222/484 |
| 4,310,108 A | * | 1/1982 | Motoyama et al. | 222/396 |
| 4,887,651 A | | 12/1989 | Santiago | 141/1 |
| 5,022,565 A | * | 6/1991 | Sturman et al. | 222/396 |
| 5,062,548 A | | 11/1991 | Hedderick et al. | 222/190 |
| 5,079,927 A | | 1/1992 | Rodino et al. | 62/99 |
| 5,124,088 A | | 6/1992 | Stumphauzer | 261/121 |
| 5,443,186 A | * | 8/1995 | Grill | 222/396 |
| 5,458,165 A | * | 10/1995 | Liebmann, Jr. | 141/64 |
| 6,019,257 A | | 2/2000 | Rasmussen | 222/400 |
| 6,105,825 A | * | 8/2000 | Gomi et al. | 222/146.6 |

FOREIGN PATENT DOCUMENTS

| | | |
|---|---|---|
| DE | 2310929 | 10/1973 |
| DE | 3515769 | 11/1986 |
| DE | 3726202 | 2/1988 |
| EP | 0 161 352 | 11/1985 |
| JP | 813397 | 5/1996 |
| WO | WO 99/47451 | 9/1999 |

* cited by examiner

*Primary Examiner*—Joseph A. Kaufman
(74) *Attorney, Agent, or Firm*—Winston & Strawn LLP

(57) ABSTRACT

An apparatus for dispensing a beverage, such as beer or soft drinks. The apparatus includes a container for storing the beverage, a gas source for supplying the container with a propellant under positive pressure, and a riser pipe for leading the beverage out of the container under the action of the positive pressure. The riser pipe has an open, first end immersed in the beverage and an opposite, second end fluid-connected to a faucet for dispensing the beverage. The gas source is connected to the interior of the container via a gas conduit, and the fluid-connection includes a fluid conduit arranged to offer a considerable resistance against the flow of the beverage during drawing. The apparatus according to the invention has a simple and inexpensive construction and is easy and quick to operate. By activating the faucet the drawing process takes place in a self-regulating manner with a preselected degree of foaming. The apparatus can advantageously be constructed in relatively small sizes that are well suited for use in private homes and in smaller public houses.

12 Claims, 3 Drawing Sheets

APPARATUS FOR DISPENSING A BEVERAGE

CROSS-REFERENCE TO RELATED APPLICATIONS

This application is a continuation of the U.S. national phase designation of International application PCT/DK00/00604 filed Nov. 1, 2000, the content of which is expressly incorporated herein by reference thereto.

TECHNICAL FIELD

The invention relates to an apparatus for dispensing a beverage, such as beer or soft drinks, and comprising a container for storing the beverage, a gas source for via a gas conduit supplying the container with a propellant under pressure, a riser pipe serving for leading the beverage out of the container under the action of the above positive pressure and having an open, first end immersed in the beverage and an opposite, second end fluid-communicating with a faucet for drawing the beverage.

BACKGROUND ART

Beverages such as beer and soft drinks are largely distributed to restaurants and similar public houses in transportable containers under pressure by a propellant normally consisting of $CO_2$ or at least having a considerable content of $CO_2$.

The propellant keeps the beverage fresh and effervescent and furthermore serves for via a riser pipe expelling the beverage from the container at drawing.

Conventionally, such a container is provided with a double valve with two fluid passages. The valve is opened by means of a coupling that is mounted on the double valve. When the valve is open, the container is via one of the fluid passages in open communication with a compressed-gas source, e.g. compressed-gas cylinder or cartridge connected to the coupling via a reduction valve whereas the riser pipe via the second fluid passage is connected to a faucet connected to the coupling.

At actuation of the faucet the beverage is expelled by the gas overpressure in the container via the second fluid passage and the faucet into a drinking glass to be served to the guest. At the same time the container is via the first fluid passage filled with new propellant in replacement of the expelled beverage.

For practical reasons, the containers that are conventionally utilized in public houses normally contain an adequately large quantity of beverage that typically can be 25 or 50 liters.

The thus known apparatuses are popular and are largely used for serving among other things draught beer.

Draught beer is generally served with a rather limited amount of foam. It is the beer that the guest has to pay for and it is therefore not in the guest's interest that a larger or smaller part of the paid beer is replaced by airy foam.

However, the foaming process can only be controlled with difficulty. This is due to the inherent physical fact that the pressure in the beer necessarily has to drop suddenly from the positive pressure in the container to atmospheric pressure at discharge from the faucet.

Thereby, the gas dissolved in the beer is liberated forming large amounts of gas bubbles that are very stable due to the large surface coefficient of the beer. Or in other words the beer will foam excessively and will only resettle slowly as the gas bubbles burst.

The operator can try to reduce this unfavorable foaming tendency by manipulating the faucet so that the drawing will pass off slowly. Thereby, costly working time is however lost just as the guest—often impatiently—will have to wait to get the ordered glass of beer.

Another method of controlling the foaming problem is to draw the beer in several turns with intermediate periods for giving the formed foam a chance to settle. However, this method is also time and labor-intensive and the guest still has to wait for the beverage.

In order to save time and avoid the guest having to wait, some operators draw the beer rather quickly. The relatively large amounts of foam formed thereby are then successively brushed off by means of a stick with the result that foam and with it not unimportant quantities of beer are wasted. The method is quick but the quickness is obtained at the expense of economy.

Thus, there is a need for an apparatus that overcomes the problems and disadvantages of the prior art.

SUMMARY OF THE INVENTION

The present invention now provides an apparatus for dispensing a beverage such as beer or a soft drink and is arranged in such a way that the beverage is drawn forcedly with a preset degree of foaming. In addition, this apparatus is of a simple and inexpensive construction. In particular, the apparatus can be quickly and easily installed and operated. In particular, the apparatus is arranged to distribute relatively small quantities of beverage.

These advantages are provided in an apparatus that includes a container for storing the beverage, a gas source and gas conduit associated with the container for supplying the container with a propellant under pressure, a faucet for drawing the beverage from the container, a riser pipe for leading the beverage out of the container under the action of the pressure and having an open, first end immersed in the beverage and an opposite, second end in fluid-communication with the faucet, and a nonreturn valve arranged to offer considerable resistance against flow of propellant into the container and to cause the pressure in the container to drop during the dispensing process.

Preferably, the fluid conduit is arranged to during drawing offer a sufficiently great resistance against flow of beverage that the beverage leaves the fluid conduit with a positive pressure of between 1% and 50% of the positive pressure in the container. Also, if desired, the device can also include a reduction valve located between the gas source and the gas conduit and being arranged to allow flow of propellant from the reduction valve to the container but to prevent flow of beverage from the container to the reduction valve.

BRIEF DESCRIPTION OF THE DRAWINGS

The invention will be explained in greater detail below, describing only exemplary embodiments with reference to the drawing, in which.

DETAILED DESCRIPTION OF THE PREFERRED EMBODIMENTS

Figure 1:
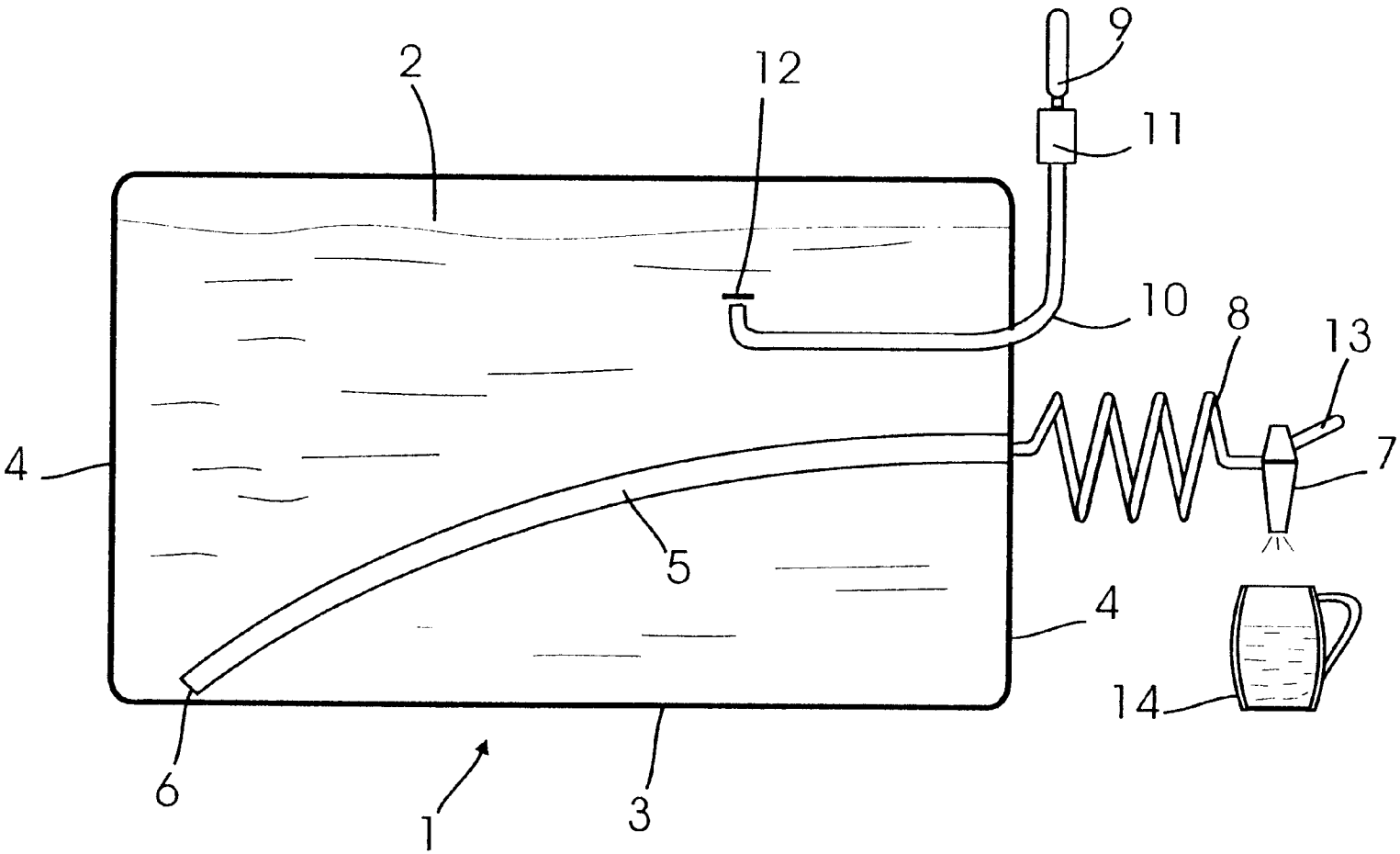
FIG. 1 is a diagrammatic view of an apparatus according to the invention.

The novel and unique features according to the invention is the fact that the gas conduit discharges into the container via a nonreturn valve arranged to offer a considerable resistance against flow of propellant. Furthermore, this construction is simple and inexpensive to manufacture and easy to operate and it is well suited for small apparatuses that are used in private homes or smaller public houses.

The apparatus according to the invention can be arranged in such a way that the desired degree of foaming is obtained when the faucet is completely open. However, the output pressure of the beverage and thus the degree of foaming depends on among other things the gas pressure in the container.

When the gas pressure in the container is at a maximum, the degree of foaming will therefore correspondingly be the largest. By arranging the gas conduit to have a considerable resistance against flow of propellant, it is obtained that the gas pressure in the container drops during the dispensing process because the propellant then is not able to fill up quickly enough after the displaced beverage.

Thereby, the output pressure of the beverage drops and thus the degree of foaming so that the dispensing process becomes self-regulating.

However, if the dispensing is stopped for a moment, the positive pressure in the container is quickly built up to a maximum again. This characteristic can be utilized with advantage by the operator to give a glass of beverage that seems flat a top-dressing with a little more foam.

The propellant is normally supplied to the apparatus from a gas cylinder or cartridge in form of a mini gas cylinder. A cylinder or cartridge can contain a large quantity of propellant because the gas here is in condensed state under high pressure.

The high gas pressure means that it is necessary to insert a reduction valve between the gas conduit and the cylinder or cartridge to reduce the gas pressure to a practical value, for example 1.8 bar.

A reduction valve is a rather complicated mechanism that cannot stand being flooded by the liquid beverage. In order to eliminate this risk, the nonreturn valve can be arranged in such a way that it allows propellant to flow from the reduction valve to the container but prevents flow of beverage from the container to the reduction valve.

In an advantageous embodiment the gas conduit can be introduced in the container via the interior of the riser pipe and open into at least one opening made in the wall of the riser pipe.

In this embodiment the nonreturn valve can quite simply consist of a piece of elastomeric tube tightly surrounding the riser pipe in an area at said opening in the wall of the riser pipe.

In an especially advantageous embodiment the riser pipe can conversely be introduced in the container via the interior of the gas conduit, this conduit can be connected to the container via at least one opening in its wall, the opening can open into an exterior groove on the wall, and in this groove can be fitted a sealing ring forming the nonreturn valve. Thereby an unfailing nonreturn valve is obtained.

The opening can furthermore advantageously point upwards whereby it is effectively ensured that the propellant during inflow into the container will not form foam in exactly the place where the beverage is driven into the riser pipe during drawing.

The faucet will normally in itself offer a certain resistance against the flow of the beverage. The resistance can be rather great when the faucet is almost closed and insignificant in the completely open state of the faucet.

As mentioned earlier some operators utilize this characteristic in an attempt to draw the beverage with as little foam as possible. The method is however risky, difficult, and time-consuming.

The flow resistance in the fluid conduit can be arranged in many different ways but is in an advantageous embodiment created by designing the fluid conduit as a long, thin tube.

Such a fluid conduit is simple and inexpensive to manufacture and functions with a uniform flow resistance per unit length so that the pressure in the beverage is gradually reduced depending on its immediate longitudinal position in the fluid conduit during dispensing. The pressure reduction therefore passes off in a way that is gentle with the structure of the beverage.

Even though the fluid conduit thus is designed with a great length, it can be built compactly into the apparatus when it is wound up into a helical shape and the turns are lying close next to each other.

At drawing the beverage is forced to flow through the fluid conduit, overcoming the flow resistance in this conduit. The beverage therefore leaves the fluid conduit with a pressure that is smaller than the pressure in the container itself. This smaller pressure results in correspondingly less foaming.

The value of the output pressure and thus the degree of foaming depends on the value of the flow resistance and the positive pressure in the container.

According to the invention the value of these parameters are chosen so that the desired degree of foaming is obtained when the beverage is drawn.

A good result is obtained when the fluid conduit is arranged to during drawing offer such a great resistance against flow of the beverage that this beverage leaves the fluid conduit with a positive pressure of between 1% and 50%, preferably between 5% and 25%, and especially between 10% and 20% of the positive pressure in the container.

The operator now merely has to activate the faucet after which the beverage is drawn forcedly with the desired degree of foaming.

The container can expediently be horizontally oriented with vertical ends whereas the riser pipe can be introduced into the container via one of these ends. In this case the riser pipe can be extending in a curved shape or obliquely downwards towards a low-lying area of the container in order to thereby ensure that the container can ultimately be completely emptied and that none of its content is wasted.

The pressure of the propellant depends on the temperature. The gas pressure increases with the temperature with a normally unwanted increase in foaming as a result.

By enclosing the container in a thermally insulated cabinet the gas pressure and thus the degree of foaming can be kept at the desired level for a considerable period of time.

Typically, the container is cooled in a refrigerator before it is placed in the cabinet.

In the following description of the drawings, the invention is described on the basis of the assumption that the beverage is beer 2 and that the container is a disposable can 1 that in advance is filled with beer.

FIG. 1 shows such a can 1 consisting of an enclosure 3 closed at each end by an end 4. As can be seen the can is lying down and has vertically placed ends.

A riser pipe 5 is extending—in this case—from a centre area on one of the ends curvedly down towards a low-lying area 6 in the can. The riser pipe is fluid-connected to a faucet 7 via a long beer conduit 8. Propellant, for example $CO_2$, is led from a gas cartridge 9 into the can via a gas conduit 10. In the cartridge the gas is in condensed state under high pressure. The pressure is therefore reduced to e.g. 1.8 bar by means of a reduction valve 11 inserted between the gas cartridge 9 and the gas conduit 10.

As can be seen, the inner end of the gas conduit is bent upwards and here provided with a nonreturn valve 12, only shown diagramatically.

When the gas cartridge 9 is connected to the apparatus, the beer in the can is immediately put under positive pressure by the gas. The value of the positive pressure is established by adjusting the reduction valve.

Upon receipt of an order for a glass of beer, the operator activates the faucet 7 by operating a handle 13. Thereby, the gas pressure in the can drives beer in through the lower end of the riser pipe 5 at the area 6 and via the riser pipe 5 and the beer conduit 8 further out to the activated faucet 7 from where the beer is then send down into a beer glass 14 under the faucet.

The beer conduit consists of a long, thin tube that offers such great resistance against flow of beer that this beer leaves the beer conduit with a positive pressure of between 1% and 50%, preferably between 5 and 25%, and especially between 10% and 20% of the positive pressure in the can.

The beer thus leaves the beer conduit with a gas pressure that is considerably smaller than the gas pressure in the can 1. The tendency of the beer to foam in the beer glass 14 is therefore correspondingly reduced.

Now, the operator only has to activate the faucet after which the beer is automatically dispensed with a preset degree of foaming without the operator in this connection having to or altogether able to intervene actively in the course of the process.

Owing to the curved shape of the riser pipe which positions its lower inlet opening close down towards the low-lying area 6 in the can, this can can in the end be completely emptied of beer. Therefore no beer is wasted when the empty can is discarded and replaced by a new one.

The beer content of the can is reduced at each drawing by the beer filled into the glass 14. The displaced beer is replaced by propellant which from the gas cartridge 9 is led into the can via the reduction valve 11 and the gas conduit 10.

The nonreturn valve is arranged with such a great resistance against passage of the gas that the can does not have time to be refilled with propellant at the same rate as beer is dispensed.

This means that the gas pressure in the can drops in dependence on the value of the flow resistance of the nonreturn valve and on the dispensing rate of the beer.

Thereby, the differential pressure is reduced across the beer conduit 8 and thereby the tendency of the beer to foam at dispensing into the beer glass 14.

Normally, the beer is wanted dispensed as soon as possible in order to thereby save working time and make sure that the guest does not have to wait any longer than absolutely necessary for the ordered glass of beer to be served.

The operator will therefore tend to immediately turn on the faucet completely. In conventional apparatuses such a manoeuvre will result in increased foam development. The apparatus according to the invention is however provided with the above means that ensure against increased foam generation.

The apparatus is thus self-regulating. The tendency of the beer to foam at drawing is controlled all the time no matter how fast the operator will try to draw the beer.

If the drawing is stopped, the gas pressure in the can is quickly rebuilt to the determined maximum operating pressure by the reduction valve 11. If the faucet then is opened with maximum operating pressure in the can, an increased foam generation will preliminary take place until the process is balanced again.

The period of increased foam generation is short but can optionally be used by the operator to top-dress a glass of beer that otherwise seems flat with a little foam.

Figure 2:
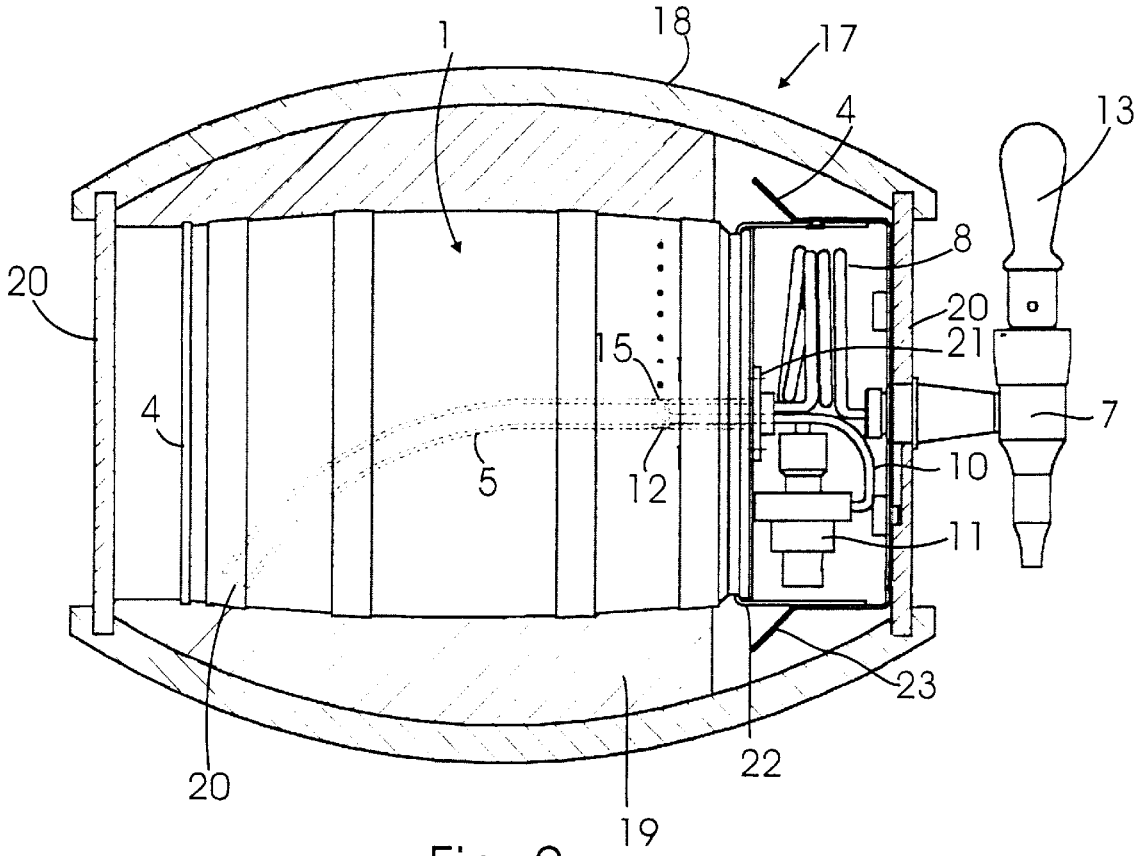
FIG. 2 is a side elevational view of an expedient embodiment of this apparatus partly in section.

FIG. 2. shows a practical embodiment of the apparatus of FIG. 1 according to the invention. Similar components are designated with the same reference numbers, and the apparatus functions in the same way as already described above with reference to FIG. 1.

As can be seen, the beer conduit 8 is in this case wound into a helical shape with closely-wound turns so that the conduit takes up very little space despite its long length.

Figure 3:
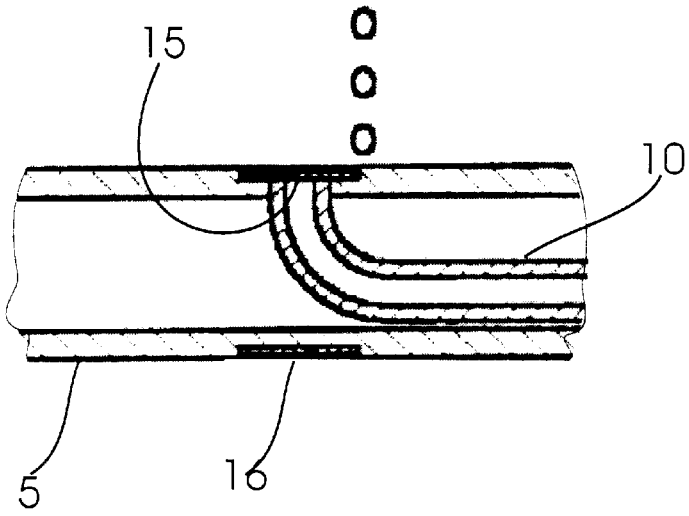
FIG. 3 is on a larger scale a fractional view of a first embodiment of a nonreturn valve according to the invention for the apparatus in FIGS. 1 and 2.
Figure 4:
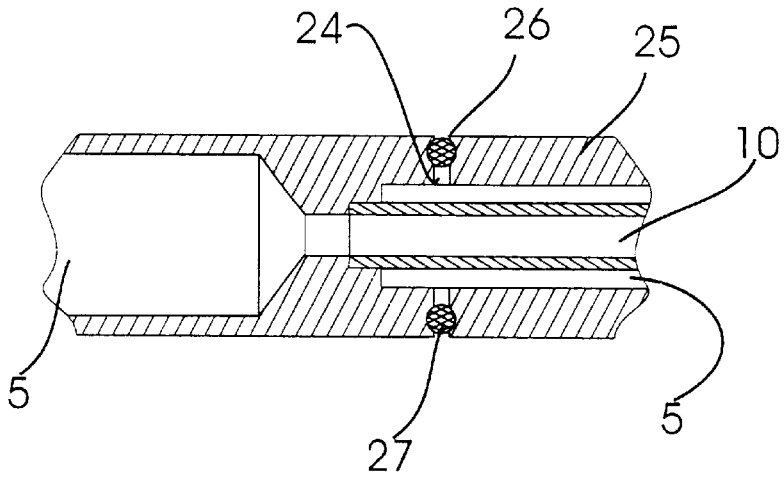
FIG. 4 is on a larger scale a fractional view of a second embodiment of a nonreturn valve according to the invention for the apparatus in FIGS. 1 and 2.

The gas conduit 10 is introduced in the can via the riser pipe 5 and opens into an opening 15 in the wall of the riser pipe. This detail is best seen in FIG. 3.

The opening 15 opens upwards. The advancing gas which is symbolised by the shown bubbles then ascends without causing turbulence and forming foam in exactly the area 6 from where the drawn beer is taken.

In the area at the opening 15 the riser pipe is tightly surrounded by a piece of elastomeric tube 16 functioning as a simple and effective nonreturn valve.

In an alternative embodiment the riser pipe 5 is introduced in the container 1 via the interior of the gas conduit 10 which then is connected to the container 1 via an opening 24 in the wall 25 of the gas conduit. In this is furthermore made an external groove 26 with an O-ring 27 forming the nonreturn valve. The O-ring 27 is kept securely in place by the groove 26 while gas is blown into the container via the nonreturn valve.

The apparatus is built into a thermally insulated cabinet 17 which for imaginary reasons is formed as a barrel with staves 18.

Between staves 18 and can 1 is placed an insulating substance 19. Prior to use the beer can is cooled in a refrigerator to a desired serving temperature. The insulating substance 19 serves for maintaining this temperature for a longer period of time in which the apparatus can be in service.

The staves are furthermore joined around a circular end bottom 20 in each end of the cabinet in such a way that the cabinet can be divided into two halves along a horizontal parting plane. Thereby the can can easily and effortless be placed in the cabinet and be taken out again when it is empty.

The faucet 7 is extending from the—seen in FIG. 2—right end bottom 20 and both the beer conduit 8 and the gas conduit 10 are communicating with the interior of the can via a plug 21 in the right end of the can.

On the can is furthermore placed a mounting 22 and on the right end bottom 20 a second mounting 23. In assembled state the two mountings 22; 23 engage each other.

The invention is described above on the exemplary assumption that the beverage is beer and the container a disposable can. It is obvious that the apparatus according to the invention also can be used for any other kind of beverage with advantage and that instead of a disposable can, a refill container can be used.

The cabinet shown in the drawing can within the scope of the invention also be formed in any other expedient or known way.

What is claimed is:

1. An apparatus for dispensing a beverage comprising a container for storing the beverage, a gas source and gas conduit associated with the container for supplying the container with a propellant under pressure, a faucet for drawing the beverage from the container, a riser pipe for leading the beverage out of the container under the action of the pressure and having an open, first end immersed in the beverage and an opposite, second end in fluid-communication with the faucet, and a nonreturn valve arranged to offer considerable resistance against flow of propellant into the container and to cause the pressure in the container to drop during the dispensing process.

2. The apparatus according to claim 1, which further comprises a reduction valve located between the gas source and the gas conduit and being arranged to allow flow of propellant from the reduction valve to the container but to prevent flow of beverage from the container to the reduction valve.

3. The apparatus according to claim 1, wherein the gas conduit is introduced into the container through the interior of the riser pipe and ends in at least one opening in the riser pipe wall, and the nonreturn valve is formed by providing an elastomer tube that tightly surrounds the riser pipe in the area at the at least one opening.

4. The apparatus according to claim 3, wherein the gas conduit ends in at least one upwardly facing opening in the riser pipe wall.

5. The apparatus according to claim 1, wherein the riser pipe is introduced into the container via the interior of the gas conduit with the conduit being connected to the container via at least one opening in a wall thereof, and with the opening ending in an external groove on the wall, and the nonreturn valve is formed by a sealing ring placed in the external groove.

6. The apparatus according to claim 1, wherein a fluid. conduit is arranged to during drawing offer a sufficiently great resistance against flow of beverage that the beverage leaves the fluid conduit with a positive pressure of between 1% and 50% of the positive pressure in the container.

7. The apparatus according to claim 1, wherein a fluid conduit is arranged to during drawing offer a sufficiently great resistance against flow of beverage that the beverage leaves the fluid conduit with a positive pressure of between 5% and 25% of the positive pressure in the container.

8. The apparatus according to claim 1, wherein a fluid conduit is arranged to during drawing offer a sufficiently great resistance against flow of beverage that the beverage leaves the fluid conduit with a positive pressure of between 10% and 20% of the positive pressure in the container.

9. The apparatus according to claim 1, wherein a fluid conduit has a helical shape with a plurality of turns lying adjacent each other.

10. The apparatus according to claim 1, wherein the riser pipe is introduced into the container via a vertically positioned end which extends in a curved shape towards a low-lying area in the container.

11. The apparatus according to claim 1, wherein the container is enclosed in a thermally insulated cabinet.

12. The apparatus according to claim 1, wherein the riser pipe is introduced into the container via a vertically positioned end which extends obliquely down towards a low-lying area in the container.

* * * * *